United States Patent [19]

Schmid

[11] Patent Number: 4,965,831

[45] Date of Patent: Oct. 23, 1990

[54] HEARING AID HOUSING WITH RETAINING FRAME

[75] Inventor: Erich Schmid, Schwaig, Fed. Rep. of Germany

[73] Assignee: Siemens Aktiengesellschaft, Berlin and Munich, Fed. Rep. of Germany

[21] Appl. No.: 249,497

[22] Filed: Sep. 27, 1988

[30] Foreign Application Priority Data

Sep. 29, 1987 [DE] Fed. Rep. of Germany ..... 8713086

[51] Int. Cl.[5] ..... H04R 25/00

[52] U.S. Cl. ..... 381/69; 381/68; 381/68.7; 381/69.2

[58] Field of Search ..... 381/69, 69.1, 69.2, 381/68, 68.7

[56] References Cited

U.S. PATENT DOCUMENTS

| | | | |
|---|---|---|---|
| 2,882,348 | 4/1959 | Erickson | 381/68.7 |
| 3,101,155 | 8/1963 | Lehr et al. | 381/69 |
| 3,102,172 | 8/1963 | Cohen | 381/69.2 |
| 3,239,093 | 3/1966 | Gath | 381/69 |
| 4,354,065 | 10/1982 | Buettner | 381/68.7 |
| 4,451,709 | 5/1984 | Waxman | 381/68.5 |
| 4,710,961 | 12/1987 | Büttner | 381/69.2 |
| 4,712,245 | 12/1987 | Lyregaard | 381/69 |

FOREIGN PATENT DOCUMENTS

| | | | |
|---|---|---|---|
| 0140078 | 5/1985 | European Pat. Off. . | |
| 1147264 | 4/1963 | Fed. Rep. of Germany | 381/68.7 |
| GM 8527362 | 9/1985 | Fed. Rep. of Germany . | |

*Primary Examiner*—Jin F. Ng
*Assistant Examiner*—Danita R. Byrd
*Attorney, Agent, or Firm*—Hill, Van Santen, Steadman & Simpson

[57] ABSTRACT

Retainers for individual structural components or a plurality of structural components are simultaneously used in order to hold the housing shells of the hearing aid together. To that end, the amplifier structure is secured to a retaining frame that is braced such between the housing shells with screws that the housing shells are drawn together. The screwed connections are arranged such that the screws are not visible when the heariing aid is worn. In an advantageous execution, some of the screws are arranged in the hearing aid and are accessible via the opened battery compartment.

6 Claims, 1 Drawing Sheet

HEARING AID HOUSING WITH RETAINING FRAME

BACKGROUND OF THE INVENTION

The present invention is directed to a hearing aid with a housing to be worn behind the ear, wherein the hearing aid has a housing composed of at least two housing shells in which housing structural components such as microphone, power source, earphone, amplifier structure, a hearing coil, an actuator arrangement and further operating elements are integrated with mounts as well as having connecting means for the housing shells.

It is always important in designing hearing aids to make use of as many space-saving measures as legitimately possible. For reasons of space-saving, amplifiers are fashioned as multi-layer, flexible foils or battery compartments are combined with on/off switches to form structural components.

The housing shells of known behind-the-ear (BTE) hearing aids are directly screwed to one another with screws. The screws are designed as small as possible and are arranged such that they optimally use little interior space required for the component parts.

SUMMARY OF THE INVENTION

An object of the present invention is to fashion a hearing aid of the type described above such that the housing shells of the hearing aid are joined to one another in an even more space-saving fashion than previously available.

The object is inventively achieved by forming the amplifier structure as a retaining frame for holding at least the individual component parts of the amplifier structure and joining the two housing shells by the retaining frame.

In the present invention, the retaining frame fulfills a double function in that it serves for retention of the component parts in the housing shells and for connecting the housing shells. The space used for the retaining frame, accordingly, is reduced greatly in comparison to known hearing aids.

The bracing between the retaining frame for the component parts and the housing shells can ensue on the basis of clamps or the like. Screws are preferably employed. According to certain embodiments of the invention, the screws for fastening the outside shell are specifically arranged next to the component parts in the inside of the hearing aid. Since they are not visible from the outside, the apparatus has an optically aesthetic effect without having to undertake involved masking measures.

Further advantages and details of the invention derive from the following description of an exemplary embodiment with reference to the drawing and in combination with the claims.

DESCRIPTION OF THE PREFERRED EMBODIMENTS

Figure 1:
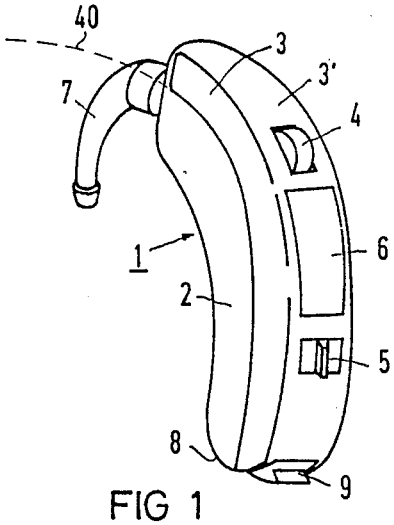
FIG. 1 is a perspective outside view of a hearing aid to be worn behind the ear and embodying the principles of the present invention.

FIG. 1 shows a hearing aid 1 to be worn behind the ear. The hearing aid housing is composed of an inner shell 2 and of an outer shell 3. Operating elements, particularly volume control 4 and switches 5 for switching between microphone and telephone coil project out of the outer shell 3 at a rear surface 3' of the hearing aid 1. A pivotable flap 6 that covers an actuator group 17, 18 is also situated on the rear surface 3'. A carrying hook 7 facilitates the positioning of the hearing aid 1 behind the ear of the hearing-impaired person and simultaneously conducts acoustic signals to the ear. A battery compartment 8 for the acceptance of a power source such as a battery that can be swivelled out is situated at the opposite end. The swivelling of the battery compartment 8 is facilitated by a finger grip 9 that projects somewhat at the end face of the hearing aid housing. No screws are visible in this view of the hearing aid. Two externally accessible screws 33 are merely situated at an inner arc of the inner shell 2, these screws, however, being covered when the device 1 is worn since the inner arc of the inner shell 2 lies against the ear. Two further screws 24 lie in the interior of the housing and are invisible for this reason.

Figure 2:
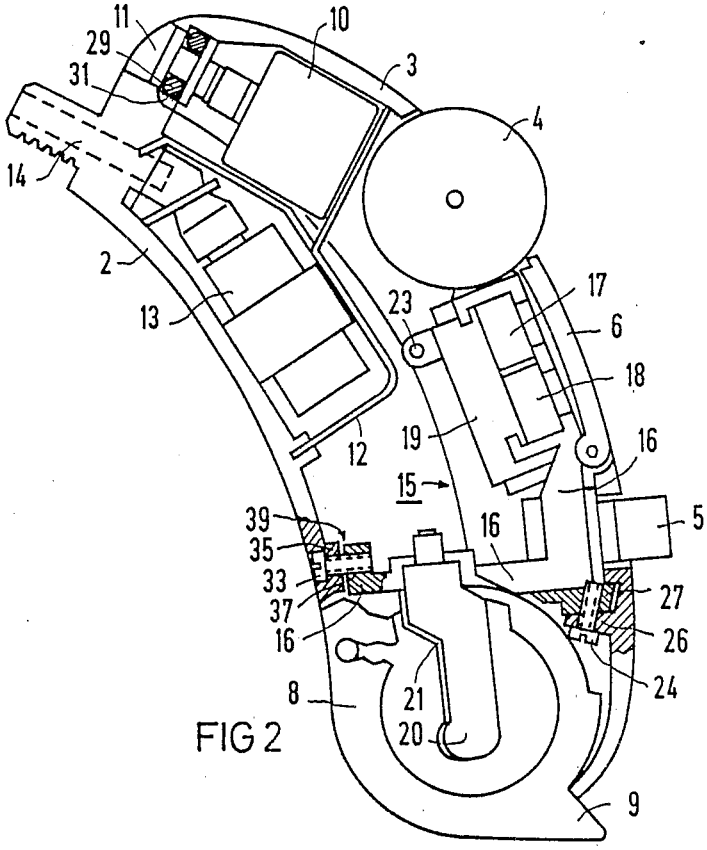
FIG. 2 is the hearing aid of FIG. 1 shown in partial longitudinal section, comprising a retaining frame for the amplifier structure that inventively holds the shells together with screws that are not visible when the hearing aid is worn.

FIG. 2 shows the component parts of the hearing aid 1 in its introduced condition. A microphone 10 is arranged at the upper end of the apparatus 1 and is connected to a sound entry opening 11. A shielding plate 12 separates the microphone 10 from a receiver 13 and from the remaining installation space of the housing 2, 3. The receiver 13 is attached to a sound channel 14 that continues on through the carrying hook 7. The receiver 13, just like the microphone 10, is protected against magnetic field effects by the shielding plate 12.

A retaining frame 16 holds the housing shells 2, 3 together to form the housing. To this end a structural unit comprising an amplifier structure 15 is first attached to the retaining frame 16. The amplifier structure 15 comprises individual component parts such as a hearing coil 19, the actuator arrangement 17, 18 and further operating elements 4, 5. Mounting means such as the screws 24 are then screwed through a strip 26 projecting from the inside of the housing shell 3, being screwed into corresponding screw holes 27 in the retaining frame 16. The inner shell 2 and outer shell 3 are subsequently pressed together, whereby connecting means such such as stoppers 29 at the inner shell 2 snap in or hook into corresponding recesses 31 at the outer shell 3. Further mounting means such as the screws 33 are then plugged or inserted from the outside into corresponding openings 35 in the shell 2 and are again screwed into screw holes 37 in the retaining frame 16. A clearance 39 between the shell 2 and the retaining frame 16 assures that the housing shells 2 and 3 are firmly drawn against one another when the screws 33 are tightened. In case the screws 24 must be serviced after the assembly of the device 1 (for example, for the purpose of re-tightening), they are accessible via the opened battery compartment 8. In order to facilitate the manufacture of the hearing aid, amplifier 15, operating elements, contact springs 20, 21 as well as further component parts are held together with the retaining frame 16 to form a testable structural unit. The structural unit enables a function testing of the device before incorporation into the housing shells.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art. Parallel and between the inner arc of the inner shell 2 and the rear surface 3' of the outer shell 3 lies the dividing plane 40 of the housing shells 2,3.

I claim as my invention:

1. A hearing aid having a housing to be worn behind the ear, said hearing aid comprising at least two housing shells and hearing aid structural components located therein, said hearing aid structural components including a microphone, a power source, a receiver and an amplifier structure, said amplifier structure being held together with mounting means and comprising individual component parts including a hearing coil and an actuator arrangement, and wherein the hearing aid comprises a retaining frame as at least part of said mounting means for holding at least the amplifier structure with its individual component parts and also for holding the two housing shells together.

2. A hearing aid according to claim 1, wherein said retaining frame is inserted between the housing shells and holds the housing shells together from the inside.

3. A hearing aid according to claim 1, wherein said retaining frame holds the housing shells together with screws.

4. A hearing aid according to claim 3, wherein at least one screw for connecting said retaining frame to one of said housing shells is arranged inside the hearing aid and is accessible via an opened power source compartment.

5. A hearing aid according to claim 3, wherein one of said shells of the housing has a side which faces toward the ear after the housing is placed behind an ear and said one shell is held at said retaining frame with at least one screw that proceeds from this side and that is therefore no longer visible after attaching at the ear.

6. A hearing aid according to claim 4, wherein the screws hold the housing shells against the retaining frame essentially in the region of the power source compartment of the hearing aid housing; and wherein, for additional support of the housing shells, said connecting means comprises a snap-in connection in the region of an end face of the housing facing toward the carrying hook.

* * * * *